United States Patent [19]

Bauman

[11] 4,290,982

[45] Sep. 22, 1981

[54] BUBBLER MAT WITH SEPARATE BOX TYPE MAT ELEMENTS

[76] Inventor: Ludwig Bauman, CH-9527, Niederhelfenschwil SG, Switzerland

[21] Appl. No.: 55,899

[22] Filed: Jul. 9, 1979

[30] Foreign Application Priority Data

Jul. 7, 1978 [DE] Fed. Rep. of Germany ..... 2829835

[51] Int. Cl.[3] ..... B01F 3/04

[52] U.S. Cl. ..... 261/124; 4/542; 128/66; 239/555; 261/DIG. 26

[58] Field of Search ..... 261/122–124, 261/DIG. 26; 128/66; 239/554, 555; 4/542

[56] References Cited

U.S. PATENT DOCUMENTS

| | | | |
|---|---|---|---|
| 944,440 | 12/1909 | Ionides | 239/555 |
| 2,663,178 | 12/1953 | Schwartz | 261/124 X |
| 2,721,064 | 10/1955 | Reichardt | 261/124 X |
| 2,997,285 | 8/1961 | Lefmann | 261/124 |
| 3,031,685 | 5/1962 | Baumann | 261/124 X |
| 3,076,976 | 2/1963 | Bogar | 261/124 X |
| 3,269,666 | 8/1966 | Leevw | 239/555 X |
| 3,352,548 | 11/1967 | Godet et al. | 261/124 |
| 3,754,740 | 8/1973 | Piper | 261/124 |
| 3,814,399 | 6/1974 | Melreit | 261/124 |
| 4,048,266 | 9/1977 | Baumann | 261/124 X |

FOREIGN PATENT DOCUMENTS

| | | | |
|---|---|---|---|
| 7719933 | 10/1977 | Fed. Rep. of Germany . | |
| 2728653 | 6/1978 | Fed. Rep. of Germany . | |
| 2729198 | 6/1978 | Fed. Rep. of Germany . | |
| 2731139 | 8/1978 | Fed. Rep. of Germany . | |
| 289801 | 10/1931 | Italy | 261/122 |
| 1550361 | 8/1979 | United Kingdom . | |

*Primary Examiner*—Richard L. Chiesa
*Attorney, Agent, or Firm*—Andrus, Sceales, Starke & Sawall

[57] ABSTRACT

A bubbler mat is formed with individual box-type mat elements. The mat elements are connected in an air determining manner through air supply channels. The mat elements are formed of connectable part shells and have air discharge openings along an essentially horizontal connection plane.

26 Claims, 14 Drawing Figures

BUBBLER MAT WITH SEPARATE BOX TYPE MAT ELEMENTS

The invention relates to a bubbler mat with separate box type mat elements, which are connected in an air determining manner through air-supply channels and are joined to an air-supply, whereby the mat elements have air discharge openings and are formed of connectable part shells, whose connection plane runs essentially horizontally.

The above described bubbler mat with box type mat elements has been known, for example, by DE GM No. 77 19 933. With these known bubbler mats, the air discharge openings are formed as borings, and are placed in the upper and lower sides of the respective part shells. However, there is the associated disadvantage that the air discharge openings must be produced through milling, boring, or punching by means of a heated tool. This production technique is however relatively costly.

With the known bubbler mats the decalcification of the air discharge bores is extraordinarily difficult and time consuming, because a decalcifying means must be charged in the entire bubbler mat. In this connection, the result is not always certain so that one or a plurality of air discharge bores nevertheless remain blocked because, additionally, foreign bodies from the water system or other obstacles have lodged in the respective air discharge openings. Over all also, the production of box-formed mat elements is relatively expensive because these are individually manufactured and thus require relatively complex tools and a difficult to control heat balance during the injection process. Further, universal adaptability is lacking with the heretofore known bubbler mats, which employ individual box formed mat elements. For example, it is not possible with the known mats to provide two separated chambers in an individual box formed element, from which, for example, the first chamber is provided with relatively small air discharge bores and thus is utilizable as bubble sprayer bath, while at the same time the other chamber is provided with larger air discharge bores and finds use as a sprayer bath.

It is the object of the present invention to so further develop a bubbler mat of the initially named type, that the production cost of the individual mat elements, and particularly the costs for the production of the air discharge bores, are essentially reduced. Further, costly decalcification measures can be avoided, in order to keep the air discharge bores free of calcifications and particularly to permit a simple decalcification. The bubbler mat according to the invention can be universally usable and interchangeable, including both air discharge openings for a bubble sprayer bath as well as for a normal sprayer bath.

The object is attained through the invention particularly in that the air discharge openings are so formed that in the connection plane of the pair of part shells, connection openings are provided at least in one part shell between the air supply canal and the water.

An essential feature of the present invention is that in the connection plane of the pair of part shells, predetermined fluid passages are provided, which are designated in the further description as connection openings. These connection openings can be provided as half-open grooves in either the one part shell or the both part shells, whereby the half-open grooves of both part shells, in the latter case, then complete a round cross-section. Further it maybe provided that wider additional connection openings are thus produced which are provided in the mat elements as troughs, in which further connection openings are provided. In this connection the part shells can either symmetrically or asymmetrically be formed.

Instead of the use of half-open grooves, which so complete each other that a round cross-section is obtained, it is also possible to obtain air discharge openings through differently profiled grooves with a cross-section formed other than round.

On the basis of the circumstances, that air discharge openings are arranged laterally on the mat elements in the connection plane of both part shells, it follows in the advancement of the technical teaching, that one simultaneously can now achieve also a better preheating of the air discharge from the air discharge openings, that the periphery of the mat elements rises over the air discharge openings and preferrably above these so that the air discharge openings find a longer sprayer span and thus are preheated in the warm bath water.

Through the use of part shells follows the essential advantage that a particularly simple air determining connection between the part shells is possible, which is always repeatably openable.

It further follows that the part shells through simple connection elements are further connectable and disconnectable with each other so that a desired box type system can be constructed.

A further possibility in the production of connection openings i.e. air discharge openings, exists in that in the connection plane at least one gasket is arranged between the part shells which separates the air supply between the upper and lower part shells. It is thus possible, to arrange different connection openings with different diameters between the connection plane of the upper part shell with the gasket and the connection plane of the lower part shell with the lower part of the gasket, so that the possibility exists, for example, to employ the mats on the side with coarse sprayer openings as sprayer massage mats and on the other side with fine sprayer openings as bubble sprayer mats.

Further, it is possible that connection bores are provided in the gasket in order to supply both the one mat element as well as the other with air.

Further, it is possible, to arrange, transverse to the connection plane of the part shells, a running, sealing strip whereby the sealing strip can either be different in height and can thereby free air discharge openings, or present connection openings, which function as air discharge openings.

Further, it is possible that the air discharge openings present different diameters, in order to achieve different spraying in different mat elements.

In a further development it is an additional feature that air discharge openings of different diameters are provided as claimed so that the mat elements with air discharge openings of similar diameters have a similar coloration.

The mat elements maybe formed box-like and the individual mats can be supplied with different air streams with the use of valves, so that one mat element can be used as a spray bath and another mat element as a bubble bath.

Further, it is provided that additional air discharge openings on the face of each mat element maybe arranged according to the technical teaching of the basic embodiment of the invention, while in a modified embodiment it is proposed that air discharge openings are so formed that in one of the pair of part shells a plurality of grooves in a stepped reset wall.

In a further embodiment it is proposed that each mat element comprises two or more chambers separated from each other and that the first chamber presents air discharge openings for use as a spray bath and the other chamber presents air discharge openings for use as a bubble bath and the air supply is controllable to the individual chambers through valves. Such a control of the air supply to the individual chambers can, for example, result through an air distribution head, as is shown in DE-OS No. 27 31 139.3 or DE-OS No. 27 28 653.0. The disclosure of these two patents is completely incorporated in the present specification, insofar as it serves for explanation of the present inventive concept.

It is similarly possible to provide additional air supply controls as they are described in DE-OS No. 27 29 198.1. Also, the disclosure of this application should be fully incorporated in the present specification.

The inventive concept of the present invention extends not only to the object of the individual claims, but also to mutual combinations of the patent claims.

Several exemplary embodiment of the present invention will now be further described with the aid of the drawing. Additionally, further advantages and features of the invention will be apparent from the drawings and their description.

The drawings show:

Figure 1:
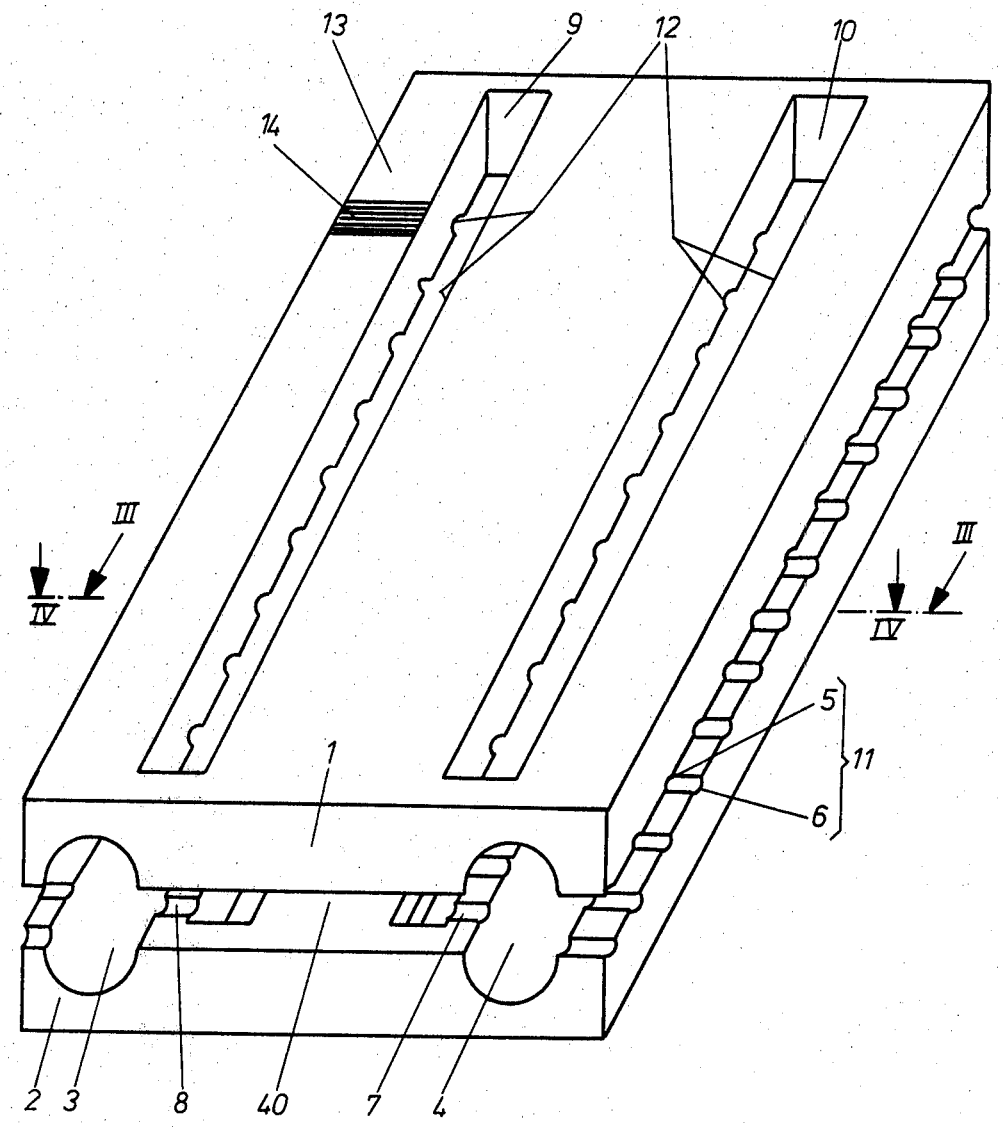
FIG. 1 is a perspective view of a mat element with the part shells not completely on top of each other and closed together.

In FIG. 1 a mat element comprises two part shells 1 and 2. The part shells are in the present exemplary embodiment formed symmetrically to the connection plane 40. Each part shell comprises a single sided, half-open shell, which with their openings are laid on top of each other. In each part shell a half-open groove of the supply canal 3, 4, is formed. From the respective supply canal 3, 4, branch off in the connection plane 40 of each part shell 1, 2, half-open grooves 5, 6, 7, 8, which connect the respective supply canals 3, 4, with the outer side of the mat element. In the exemplary embodiment shown, the half-open grooves 5, 6, are mutually arranged, that is, by the on top of each other positioning and the mutual joinder of the part shells 1, 2, circular air discharge openings 11 are formed in the surfaces of the mat elements.

In order to increase the spraying capacity of the mat element troughs 9, 10 are arranged symmetrically to the middle plane inside each part shell 1, 2 in which similarly empty half-open grooves 7, 8 which go out from the respective supply canal 3, 4. In this way, are formed, respectively, two rows of air discharge openings 12 in the troughs, so that in each mat element altogether six rows of air discharge openings 11, 12, are given. Equally is it possible the faces of the mat elements with corresponding discharge openings to provide which are formed in the same way out of grooves.

The upper surface 13 of each part shell 1, 2, can be provided with sliding inhibiting ribs or grooves or nubs. It is only of importance to the exemplary embodiment that in the connection plane 40 of the two part shells 1, 2, are formed half-opened grooves or channels, which with the joining together of the part shells form the air discharge openings.

It is possible to form the upper and lower part shells, 1, 2, of different materials. For example, the upper part shell 1 can be formed of a flexible material and the lower part shell 2 out of a relatively hard plastic material.

Figure 2:
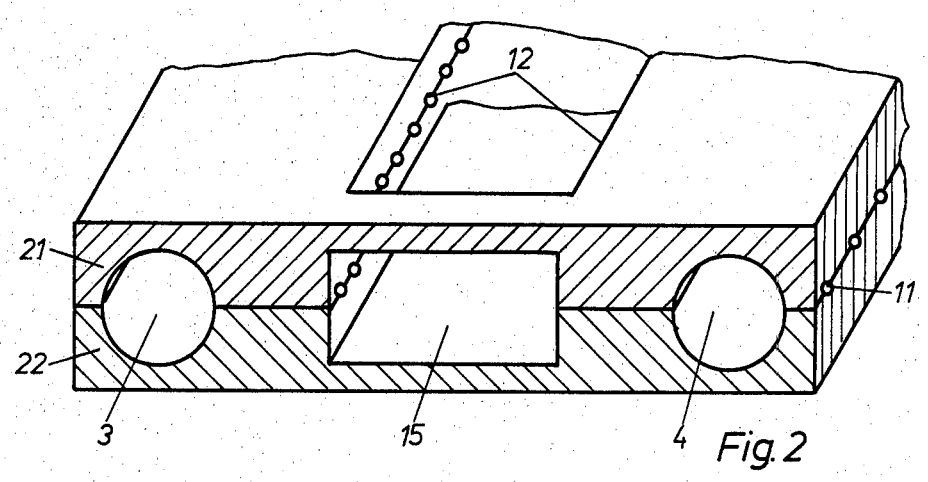
FIG. 2 is a sectional view through one exemplary embodiment of a mat element taken along a line corresponding to a section IV—IV in FIG. 1.

FIG. 2 shows a further exemplary embodiment of the mat element. From the drawing it is apparent that adjacent the air supply canals 3, 4, a further canal 15 can be provided in whose side walls air discharge openings 12 are formed. This canal 15 can extend through the part shells 21, 22, so that this mat element can find use as an air spray mat both from the one, as well as from the other, side.

Figure 3:
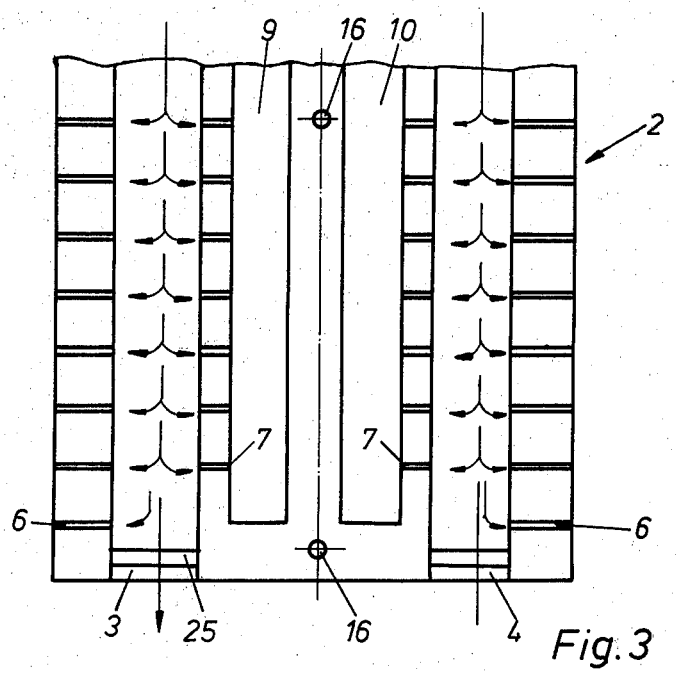
FIG. 3 is a horizontal section along the line III—III in FIG. 1. (plan view of the lower shell)

FIG. 3 shows a plan view of the part shell 2 according to FIG. 1. From the drawing, the air distribution in the supply channels 3, 4, is apparent. The air coming in from the upper portion of the drawing will pass through the grooves 6, 7, into the individual air discharge openings. The part shells can be provided with bores 16, which engages a threaded bolt and which is threaded into a coordinated thread of the other part shell. Similarly, the connection between the part shells can likewise be accomplished lockingly or through rivets or other connection means.

Figure 9:
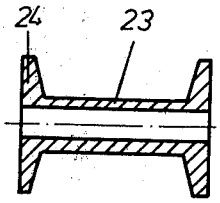
FIG. 9 is a section through an air-connection tube for the air determining connection of individual mat elements.

The air determining connection between the individual mat elements so results that in the area of the surface of each supply channel 3, 4, an embedding groove exists, which comprises a groove type depression running on the periphery of the air supply channels 3, 4. The flange 24 of the connection tube 23 shown in section in FIG. 9 engages in this depression. The connection tube 23 is preferably flexibly formed, so that the air determining connection of the individual mats is flexible and the mat elements can accommodate any form of the bath tub.

Figure 13:
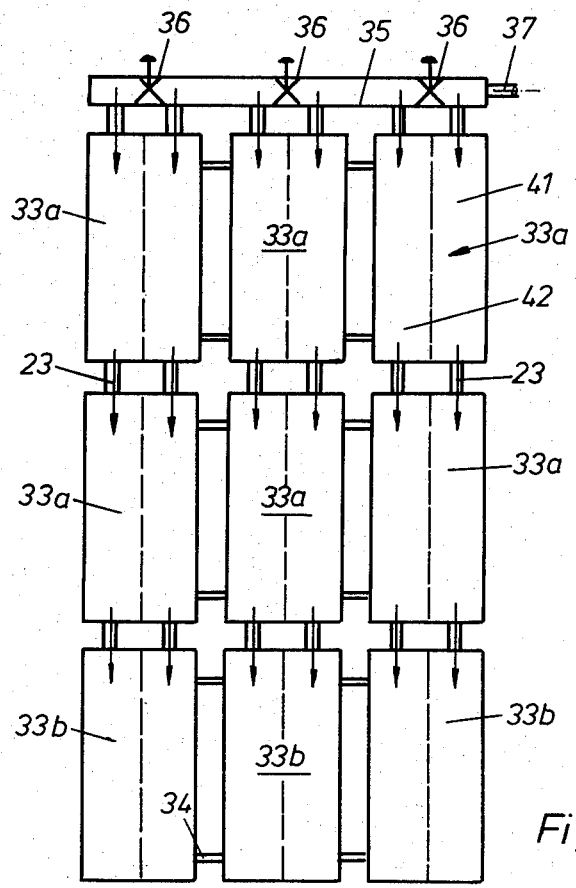
FIG. 13 is a schematically represented plan view of an air bubbler mat with a plurality of interchangeable mat elements according to the present invention.

Through the formation of the mat elements and part shells a particularly simple box-type construction of an air spray mat of the individual mat elements according to FIG. 13 is possible. Through removal of the connection means between the part shells these can simply become open, and in the embedding grooves 25 can either be inserted packing washers, which close the air supply channel 3, 4, or can be secured another mat element with its supply tube 23 through engagement of the corresponding flanges 24 in the embedding grooves 25. One is also now completely free in the construction and in the manner of the assembly of an air spray mat out of individual mat elements.

In connection with the following drawings is explained how the employment of the mat elements can be universally arranged.

Figure 4:
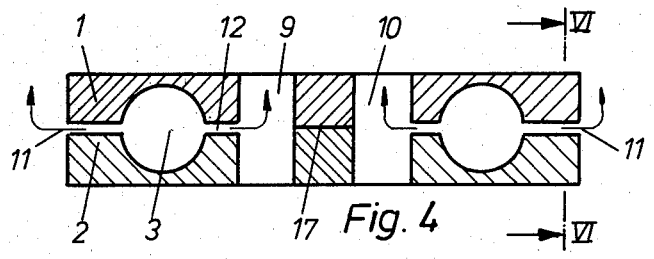
FIG. 4 is a vertical section along the line IV—IV in FIG. 1.

FIG. 4 shows the section IV—IV of FIG. 1 through the mat element shown in FIG. 1. In this view the high spray conductors of such a mat element are seen, that in total four rows of spray openings with two next to each other lying troughs 9, 10 are possible.

Figure 5:
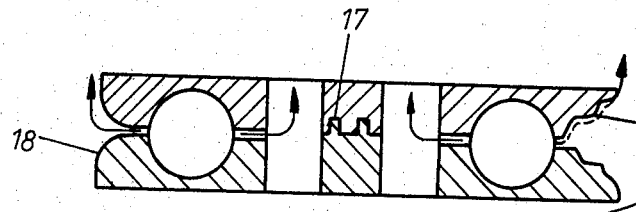
FIG. 5 is a vertical section taken along a line corresponding to the line IV—IV in FIG. 1 with a further exemplary embodiment.

FIG. 5 shows that the connection of the individual part shells 1, 2, is possible through groove-rib connectors 17 in the connection plane 40 between the part shells 1, 2.

For the preheating of the air draft, that issues out of the air discharge bores, a special prolongation of the spray interval is provided so that the air draft covers a longer water interval until it meets the body of the bather. Through this prolongation of the spray interval the air is preheated better. In addition to this, it is provided that the edge 18, 19 of each part shell slants with respect to the horizontal or is distorted, as is, for example, shown in FIG. 5. Through this the air draft is forced to cover a long interval because the edge 19, for example, is formed out of individual successively following bends so that the air draft must follow the bends. Likewise it is possible, as is for example shown on the edge 18, to form these as nozzles with respect to the air discharge bores, so that through this a prolongation of the spray interval is again provided.

Figure 6:
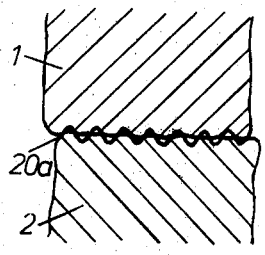
FIG. 6 is a vertical section and side view through a first exemplary embodiment of the formation of the air discharge openings.
Figure 7:
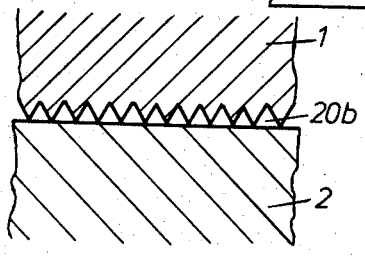
FIG. 7 is a second exemplary embodiment comparable to FIG. 6.
Figure 8:
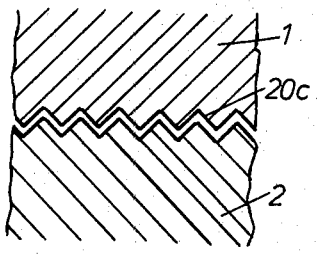
FIG. 8 is a third exemplary embodiment comparable to FIG. 6.

In the FIGS. 6–8, different possibilities for the formation of the air discharge openings 20*a* through 20*c* are shown. In the exemplary embodiment of FIG. 6, the grooves which produce the connection of the side surfaces of the part shells to the air supply canals 3, 4 are formed out of half circular ribs, which lie one on top of the other to establish the air discharge openings 20*a*.

In the exemplary embodiment of FIG. 7 the one connection plane of the part shell 2 is planar formed, while the other connection plane of the part shell 1 is provided with serrated grooves, so that larger air discharge openings 20*b* are formed.

In the third exemplary embodiment according to FIG. 8 the one connection plane of the part shell 2 is provided with serrations, while the bordering connection plane of the part shell 1 is provided with similar serrations, which engage in the serrations of the other part shell. The air discharge openings 20*c* are hence particularly advantageous through their changeable cross-section because the spacing between the part shells is variable.

Figure 10:
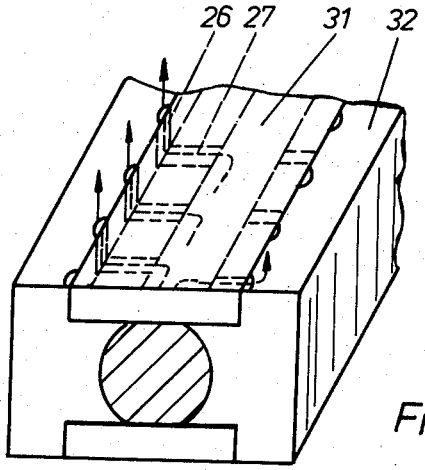
FIG. 10 is a perspective partial view of a further exemplarly embodiment of a mat element with non-symmetrical part shells.

FIG. 10 shows that the individual part shells 31, 32 can be assymetrically formed with reference to the connection plane 40 between these part shells. In the exemplary embodiment the one part shell 32 is formed of a box element with a length-wise running holder, in which is inserted the part shell 31 formed as a plate. The air discharge openings are formed as grooves 26, 27, between the connection surfaces of the pair of part shells 31, 32. It is obviously also possible to form the part shell 31 lower than the upper surface of the other part shell 32, so that the air discharge openings cannot be covered by the body of the bather lying thereover. It is further possible to provide corresponding air discharge openings alone in the second part as plate formed part shell 31, which then particularly simply can be replaced with other plates provided with changed discharge openings.

Figure 11:
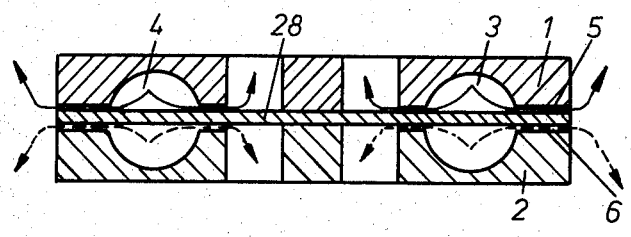
FIG. 11 is a section through a further exemplary embodiment of a mat element taken along a line corresponding to the line IV—IV in FIG. 1, however, with a gasket.

In FIG. 11 is shown as a further exemplary embodiment, that in the connection plane of the pair of part shells 1, 2, a gasket 28 can be inserted. The gasket 28 interrupts the air supply canal 3, 4, in two separated part canals. Between the gasket 28 and the connection plane of the upper part shell 1 are formed the grooves 5 shown in FIG. 1 so that the air in the marked arrow direction flows out of the air discharge openings. In the shown position the grooves 5 are, for example, relatively large so that with this use and with the supply of the respective upper part canals of the air supply canals 3, 4, an air spray bath is possible. The mat can now be turned over, whereby the lower part shell 2 now lies above. Inasmuch as now the other part canals of the supply canals 3, 4, are supplied with air, the air issues from above in the grooves 6 as the air discharge openings. The grooves 6 can be calibrated sufficiently small that use as a bubble bath is possible. In this way, a double-sided use of the air spray mat with different employment purposes is possible through the insertion of a gasket 28 dividing the pair of part shells 1, 2. It is also equally possible that the gasket is provided with additional bores in order to render possible the air supply in other areas. The gasket 28 can also be formed out of an air permeable material, for example, foamed material or sintered metal, whereby the air supplying grooves 5, 6, can be completely inapplicable. The air discharge openings would then be replaced through the air supply canals of the sintered metal.

Figure 12:
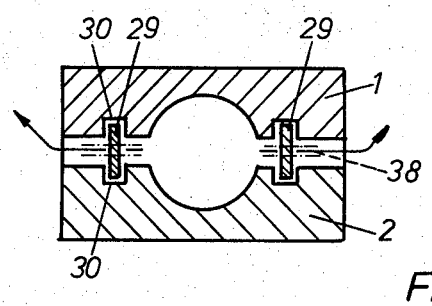
FIG. 12 is a vertical section through a further exemplary embodiment comparable to FIG. 11.

According to FIG. 12 a vertically running sealing strip can also find use, which is inserted in corresponding recesses between the part shells 1, 2. In a first exemplary form the sealing strip can close a row of air discharge openings, for example, in the exemplary embodiment of FIG. 12, the left side of the air discharge openings. The other sealing strip 29 is provided with connection bores 38 so that with the disclosed mat element only the right side of the element is provided with active air discharge openings. From this, the universal use of the mat elements according to the invention is clearly apparent because now the user has in hand, a side of the air discharge openings to close or to clear or its air supply to regulate, when he inserts in recesses 30 between the shells 1, 2, either sealing strips or strips provided with calibrated bores. The user can also arrange, corresponding his needs, a spray mat with individual and differing, spray fields.

In FIG. 13 an assembled bubbler mat, of box-type arranged mat elements 33*a* and 33*b*, is shown.

The mat elements 33*a* are here connected in the longitudinal direction through corresponding connection tubes 23. Transverse to this can obviously also result an air determining connection to the individual adjacently lying mat elements 33*a*, in which connection tubes 23 are inserted. Equally, in transverse direction the mat elements 33*a* can be flexibly connected through non-air supplying tubes.

In the exemplary embodiment six similar mat elements 33*a* and three elements 33*b* different therefrom with differently calibrated air discharge openings are utilized. The air supply to the individual chambers of the series connected mat elements 33*a*, 33*b* can be controlled through hand operated valves 36 within the air distributor head 35. Through the operation of the valves it is possible to provide individual mat regions with air and to isolate other mat regious from the air supply. In this connection it is thus possible, for example, that the mat element 33*a*, 33*b* divided in two individual chambers 41, 42 are differently connected, so that a universal adaptability of the air spray performance of the individual mats 33*a*, 33*b* to the requirements of the respective user is insured. For the differentiation of the individual mat fields—corresponding to their different spray openings—a different coloring can be provided.

Figure 14:
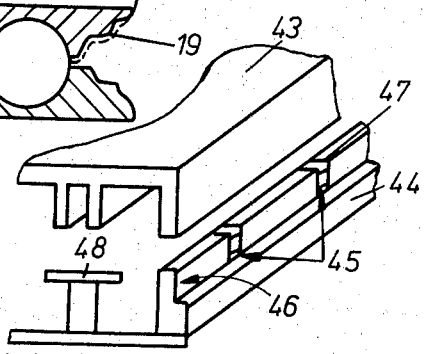
FIG. 14 is a perspective front view of a further exemplary embodiment.

In the exemplary embodiment according to FIG. 14 a further embodiment is shown, which is characterized through a particularly simple construction and through particularly easy adjustability of the air discharge openings. The bubbler mat is formed once again out of two part shells 43, 44, whereby in one of the pair of shells 44, plurality of grooves 45 are arranged in a graduated reset wall 46, over which the other part shell 43 engages, and thereby shuts the upper open part 47 of the grooves 45, so that now the lower rounded off part of the grooves 45 is free. Through changing of the spacing between the pair of part shells 43, 44, the discharge cross-section of the air discharge openings formed by grooves 45 can be varied. In addition to this, between the fastenings between the part shells 43, 44 engaged with each other, either intermediate layers 48 or also U-shaped plates can be inserted.

In a further, not more specifically disclosed, embodiment it is also possible to replace the step formed wall 46 through a thin, strip with therein arranged discharge openings. In this way a disclosed adaptability of the desired cross-section of the air discharge opening in the respectively provided relationship results.

I claim:

1. A bubbler mat having at least one box-like element connectable to an air supply, said mat element being formed of a pair of opposing part shells (1, 2, 21, 22, 31, 32) having surfaces abuttable along a connection plane (40), said part shells having complementary grooves for forming at least one air-supply canal (3, 4) connectable to the air supply and lying along said connection plane when said shells are brought into abutment, said abutting surfaces of said mat elements being so formed as to provide a plurality of air discharge openings (11, 12) lying along said connection plane, said air discharge openings being connected to said air supply canal and opening on the exterior of said part shells for producing streams of air on said exterior.

2. The bubbler mat according to claim 1 characterized in that said mat elements are formed with grooves in at least one of the abuttable surfaces for forming said air discharge openings.

3. The bubbler mat according to claim 2 characterized in that the air discharge openings (20*a*–20*b*, 20*c*) are formed through reciprocal mutual elements of different profile in the grooves in the part shells (1, 2).

4. The bubbler mat according to claims 1 or 2 characterized in that the air discharge openings are formed as half-open grooves (5, 6, 7, 8, 20*a*, 20*b*, 20*c*) in the abutting surfaces of each part shell (1, 2, 21, 22, 31, 31).

5. The bubbler mat according to claim 1 including a pair of spaced air supply canals (3, 4) and wherein said mat element includes troughs (9, 10) extending therethrough, said mat elements including additional air discharge openings connected to said air supply canals and opening into said troughs for producing streams of air.

6. The bubbler mat according to claim 1 including a plurality of box-like mat elements, said elements being coupled together by connection pipes (23) having flanges sealingly engaging in grooves (25) in said air supply canal.

7. The bubbler mat according to claim 6 characterized in that the air discharge openings (11, 12, 20*a*, 20*b*, 20) of differing mat elements (33*a*, 33*b*) have different diameters.

8. The bubbler mat according to claim 7 characterized in that the mat elements (33*a*, 33*b*) with air discharge openings of similar diameters have similar coloration.

9. The bubbler mat according to claims 7 or 8 characterized in that the mat elements (33*a*, 33*b*) are interchangeably constructed and connected in seriatim.

10. The bubbler mat according to claims 1, 6, or 7 characterized in that said mat element (33*a*, 33*b*) is formed of two or more chambers (41, 42) separated from each other and that the one chamber (41) has air discharge openings for use as a spray bath and the other chamber (42) has air discharge openings for use as a bubble bath and the air supply to the individual chambers (41, 42) is controlled through valves (36).

11. The bubbler mat according to claim 6 characterized in that for the production of the air discharge openings, the pair of part shells are connected with each other through at least one of screws, adhesive and rivets and that for the joinder of the mat elements, connecting tubes (23) of the mat elements (33*a*, 33*b*) are fastened in coacting mounting openings of the mat elements (33*a*, 33*b*) lying in the connection plane (40).

12. The bubbler mat according to claim 1 characterized in that one of said part shells has a thin interchangeable strip in which the discharge openings are arranged inserted therein over which the other part shell engages.

13. The bubbler mat according to claim 1 characterized in that the part shells (1, 2, 21, 22) are symmetrically formed with reference to the connection plane (40).

14. The bubbler mat according to claim 1, characterized in that the part shells (31, 32) are asymmetrically formed with reference to the connection plane (40) and the one part shell (32) comprises a box element with a lengthwise running holder in which is inserted the second part shell (31), formed as a plate, and that the air discharge openings are formed as grooves (26, 27) between the abutting surfaces of both part shells (31, 32).

15. The bubbler mat according to claim 1 characterized in that the edge (18, 19) of the mat elements surmounts and extends over the air discharge openings.

16. The bubbler mat according to claim 1, characterized in that the mutual connection of the part shells (1, 2, 21, 22, 31, 32) results through at least one of screws, rivets, and latch connectors (17).

17. The bubbler mat according to claim 1 characterized in that at least one gasket (28) is arranged in the connection plane (40) between the part shells (1, 2)

which divides the air supply between the part shells (1, 2).

18. The bubbler mat according to claim 17 characterized in that the gasket (28) is provided with air discharge openings.

19. The bubbler mat according to claim 1 characterized in that a running sealing strip (29) is arranged transverse to the connection plane (40) between the part shells in a groove (30) formed between the part shells (1, 2).

20. The bubbler mat according to claim 5 characterized in that the sealing strip (29) is interchangeable and the dimension of the sealing strip (29) determines the cross-section of the air discharge openings.

21. The bubbler mat according to claim 5 characterized in that the sealing strip (29) has air discharge openings.

22. The bubbler mat according to claim 1 characterized in that the air discharge openings (11, 12, 20*a*, 20*b*, 20*c*) have different diameters.

23. A bubbler mat according to claim 1 characterized in that on the surface of said mat element (33*a*, 33*b*) further air discharge openings are arranged.

24. The bubbler mat according to claim 1 characterized in that the air discharge openings are so formed that in one of the two part shells (43, 44) a plurality of grooves (45) are arranged in a stepped reset wall (46), over which the other part shell (44, 43,) engages and thus seals the upwardly opening part (47) of the grooves (45), and the lower part of the groove (45) is free.

25. The bubbler mat according to claim 24 characterized in that the spacing between the part shells (43, 44) is variable through at least one of inserts (48) and U-shaped plates.

26. The bubbler mat according to claim 1, characterized in that the part shells (1, 2, 21, 22, 31, 32) are manufactured in an injection molding process.

* * * * *